United States Patent [19]

Petty et al.

[11] Patent Number: 4,639,167

[45] Date of Patent: Jan. 27, 1987

[54] DEEP WATER MOBILE SUBMERSIBLE ARCTIC STRUCTURE

[75] Inventors: Terry D. Petty; Carmon R. Costello, both of Kenner; Kun K. Song, New Orleans; Luc G. Chabot, La Place, all of La.; Tadahiro Fujita, Kanagawa, Japan; Haruki Hirose, Kanagawa, Japan; Nobutoshi Yoshimura, Mie, Japan

[73] Assignees: Odeco, Inc., New Orleans, La.; Nippon Kokan, K.K., Tokyo, Japan

[21] Appl. No.: 726,635

[22] Filed: Apr. 24, 1985

[51] Int. Cl.[4] ..... E02B 17/00

[52] U.S. Cl. ..... 405/217; 405/61; 405/195; 405/203

[58] Field of Search ..... 405/217, 211, 61, 195, 405/203; 62/259, 260

[56] References Cited

U.S. PATENT DOCUMENTS

| | | | |
|---|---|---|---|
| 3,952,527 | 4/1976 | Vinieratos et al. | 405/217 |
| 4,080,798 | 3/1978 | Reusswig et al. | 405/217 |
| 4,245,929 | 1/1981 | Pearce et al. | 405/217 X |
| 4,325,655 | 4/1982 | Jahns et al. | 405/61 X |
| 4,335,980 | 6/1982 | DePriester | 405/61 X |
| 4,553,879 | 11/1985 | Langner | 405/217 X |

*Primary Examiner*—Dennis L. Taylor

*Attorney, Agent, or Firm*—Michael P. Breston

[57] ABSTRACT

The mobile marine drilling structure is of the submersible type for operation in ice-covered waters. The structure comprises a base for placing the structure on the sea bed, a hull extends from the base, and a deck is supported by the hull. The deck is located above the water line for conducting drilling operations. The hull has an internal frame assembly including ballast tanks, and external wall sections at different inclinations to the horizontal to engage and break up the moving ice masses encroaching on the hull. These external wall sections include a plurality of matching polygonal, frusto-pyramidal, apex-up and apex-down walls extending above the base, and two transitional wall sections to provide two inflection points to the hull.

7 Claims, 10 Drawing Figures

DEEP WATER MOBILE SUBMERSIBLE ARCTIC STRUCTURE

BACKGROUND OF THE INVENTION

1. Field of the Invention

This invention generally relates to offshore structures and more particularly to mobile submersible drilling platforms for use in arctic waters of moderate to deep depths, such as are encountered in the Beaufort Sea continental shelf area north of Canada and Alaska.

2. Description of the Prior Art

Over the continental shelf area of the Beaufort Sea, movements of large ice covers occur most of the year. As the winter progresses, the thickness of the ice cover increases. The ice generally breaks up annually leading to the open water season which lasts about 60 days. Relocation of a submersible drilling structure from one offshore drilling site to another is practical therefore only during the open water season.

Mobile arctic drilling structures have already been proposed and patented. These are intended to be towed to the desired drilling site during the short open water season and then they are submerged to rest on the sea bottom in relatively shallow arctic waters.

The known structures have sloping ice-engaging outer hull skins capable of breaking up encroaching and moving ice covers. They are primarily designed to resist the ice load expected at a specific site which is characterized by a specific water depth and by particular bottom soil conditions.

In their configurations, the known structures might be able to drill a few exploratory wells at a first site through the limited sea bed access area available to them. Since such structures become ice-locked shortly after deployment, it becomes necessary to wait for the next open water season in order to relocate to a second prospective drilling site, which must have substantially the same depth and environmental conditions as those of the first site.

Ordinarily, if a few wells drilled on the first site show a promising oil find, there is a need to develop many other wells on the first site in order to determine the economic potential of the found underground oil reservoir. Because of their inherent structural limitations, the known arctic marine drilling structures must be relocated several times over the first site in order to size up the extent of the oil and gas bearing formation.

The need to relocate the known arctic drilling structures makes the overall cost of evaluating potential offshore arctic hydrocarbon formations prohibitively expensive and wasteful of precious time, as when it is necessary to remain idle during the winter season while waiting to relocate.

Therefore, it is an object of the present invention to provide a single mobile offshore drilling structure which by using its onboard equipment can drill about four dozen developmental and production wells at a single site, which is capable of being relocated to another prospective site having largely different environmental conditions within a water depth range of 20–60 meters, which can carry sufficient supplies for drilling up to eight wells and/or operate for one full year without the need for resupply, which experiences operating loads from encroaching ice covers that are substantially of the same order of magnitude over the structure's entire operating water depth range of 20–60 meters, and which has a multi-slope deflector section with two transitional walls that automatically protects the deck from damage by broken-up large ice slabs that are forced to ride up on and then to fall off from the hull.

SUMMARY OF THE INVENTION

The mobile marine drilling structure is of the submersible bottom-founded type for operation in waters over which ice covers of various thicknesses move. The structure comprises a base for placing the structure on the sea bed, a lower hull extends from the base, and an upper deck is supported by the hull. The deck is located above the water line for conducting drilling operations and has sufficient deck space to accommodate drilling equipment and supplies. A continuous inner wall extends from the deck down to and through the base for protecting from the harsh environment the drilling operations and for providing maximum access to the sea bed. The hull has an internal frame assembly including ballast tanks, as well as external wall sections of different inclinations to the horizontal in order to engage and break up the moving ice masses encroaching on the hull. These external wall sections include a plurality of matching polygonal, frusto-pyramidal, apex-up walls extending above the base at increasing angles to the horizontal from 12 to 75 degrees. The hull further includes a deflector section which comprises a matching polygonal, substantially cylindrical first transitional wall that extends above the apex-up walls, a matching polygonal, frusto-pyramidal, apex-down wall that extends above the first transitional wall at an angle to the horizontal from 95 to 150 degrees, and a matching polygonal, substantially cylindrical second transitional wall that extends above the apex down wall at an angle to the horizontal from 90 to 140 degrees, but at an angle less than the immediately underlying apex down wall.

DETAILED DESCRIPTION OF PREFERRED EMBODIMENTS

Figure 1:
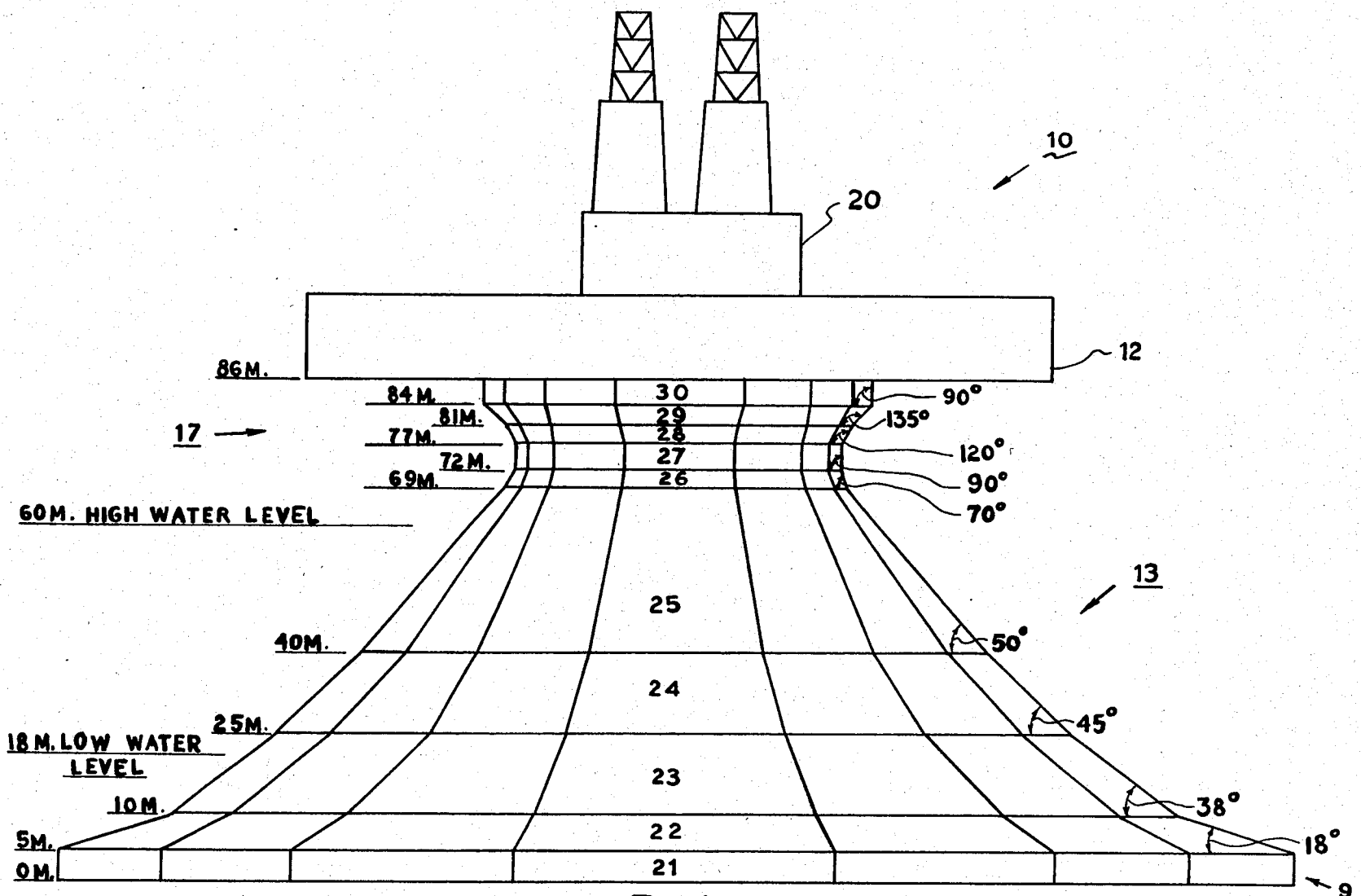
FIG. 1 is a schematic elevational view illustrating the preferred embodiment of the invention.
Figure 2:
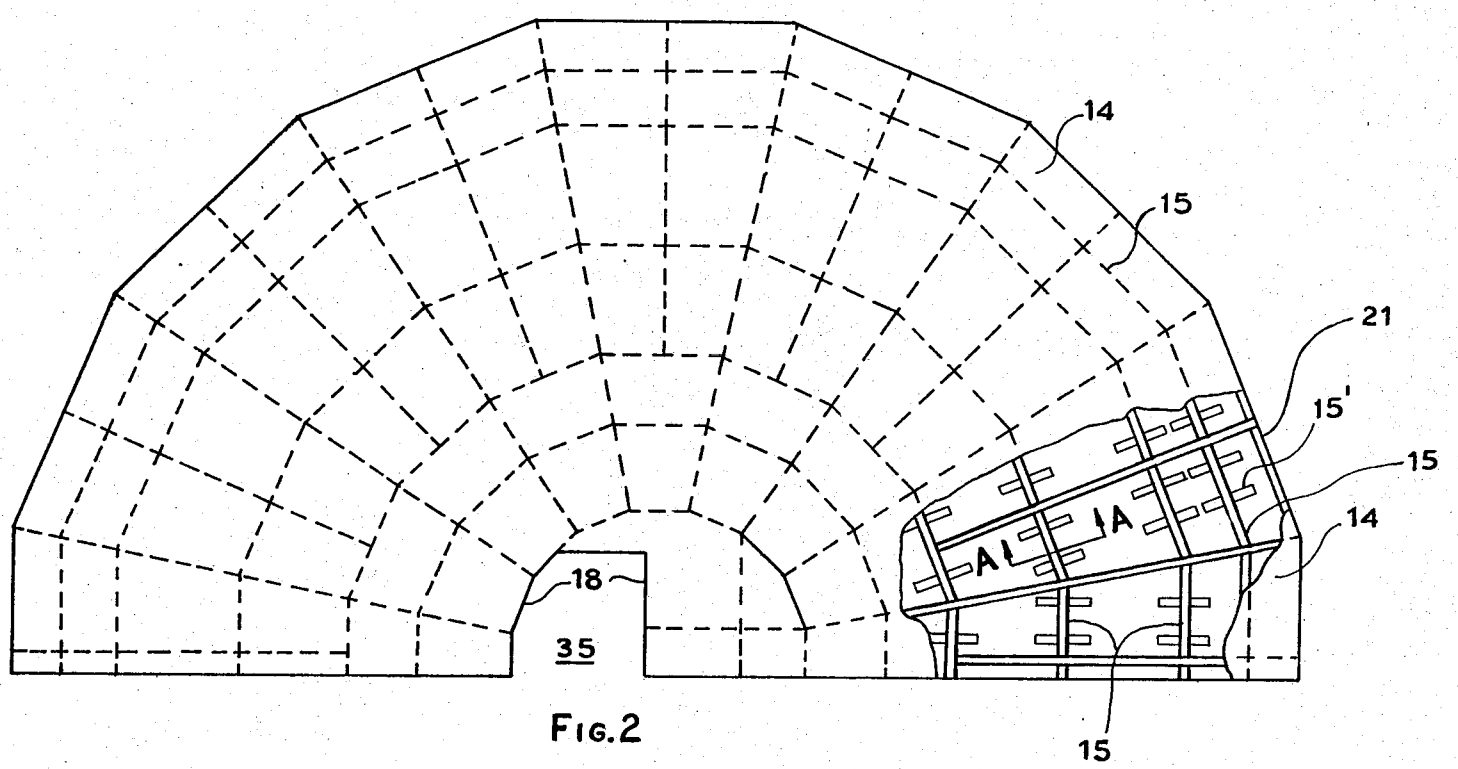
FIG. 2 illustrates the bottom hull base and skirt configuration.
Figure 4:
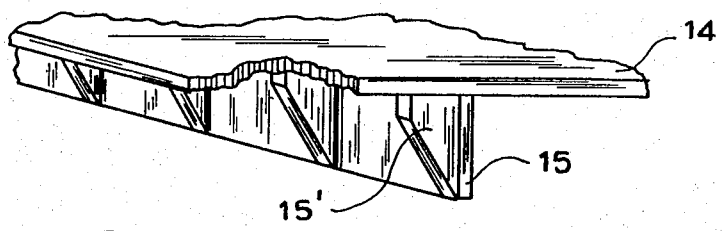
FIG. 4 is a perspective view of the portion of the base and skirt arrangement shown in FIG. 3.
Figure 3:
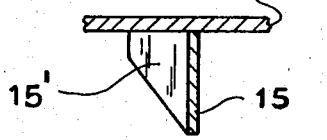
FIG. 3 is a sectional detail view of the base, taken on line A—A in FIG. 2, which shows the method of connecting the bottom hull plate and skirt.
Figure 6:
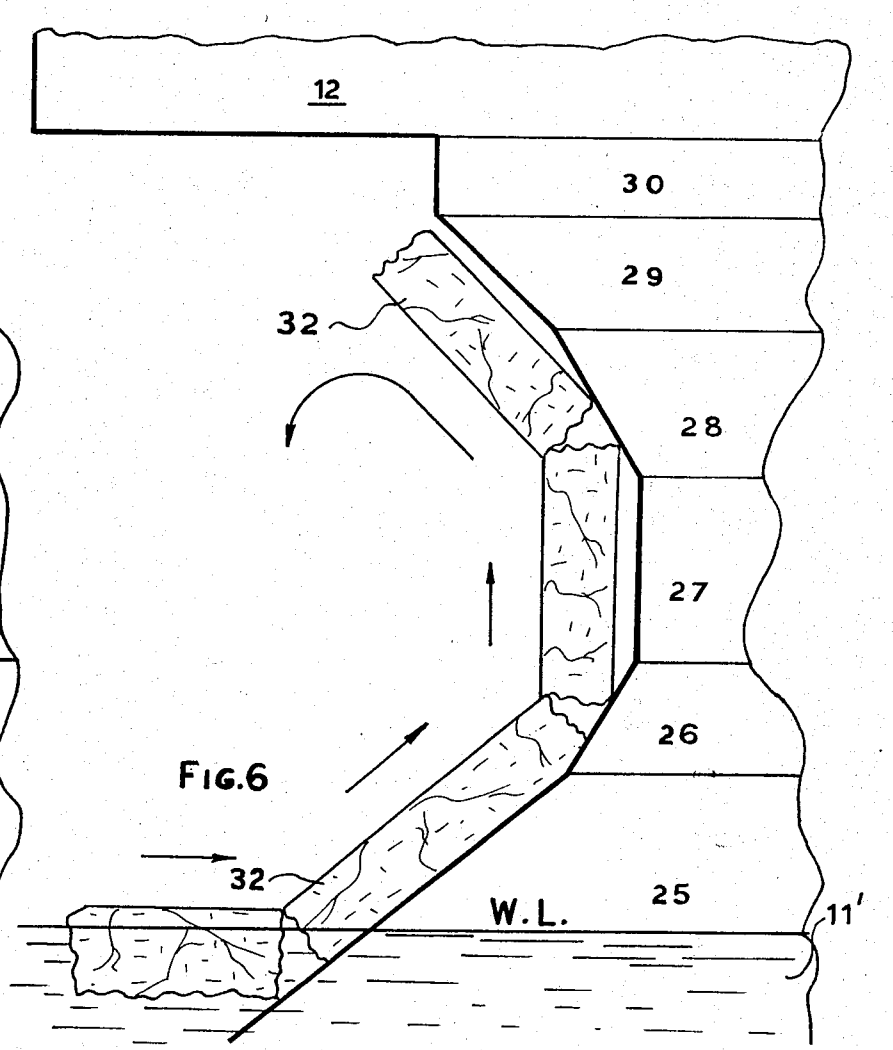
FIGS. 5 and 6 illustrate how broken ice slabs typically ride up and interact with two embodiments of the deflector section.
Figure 5:
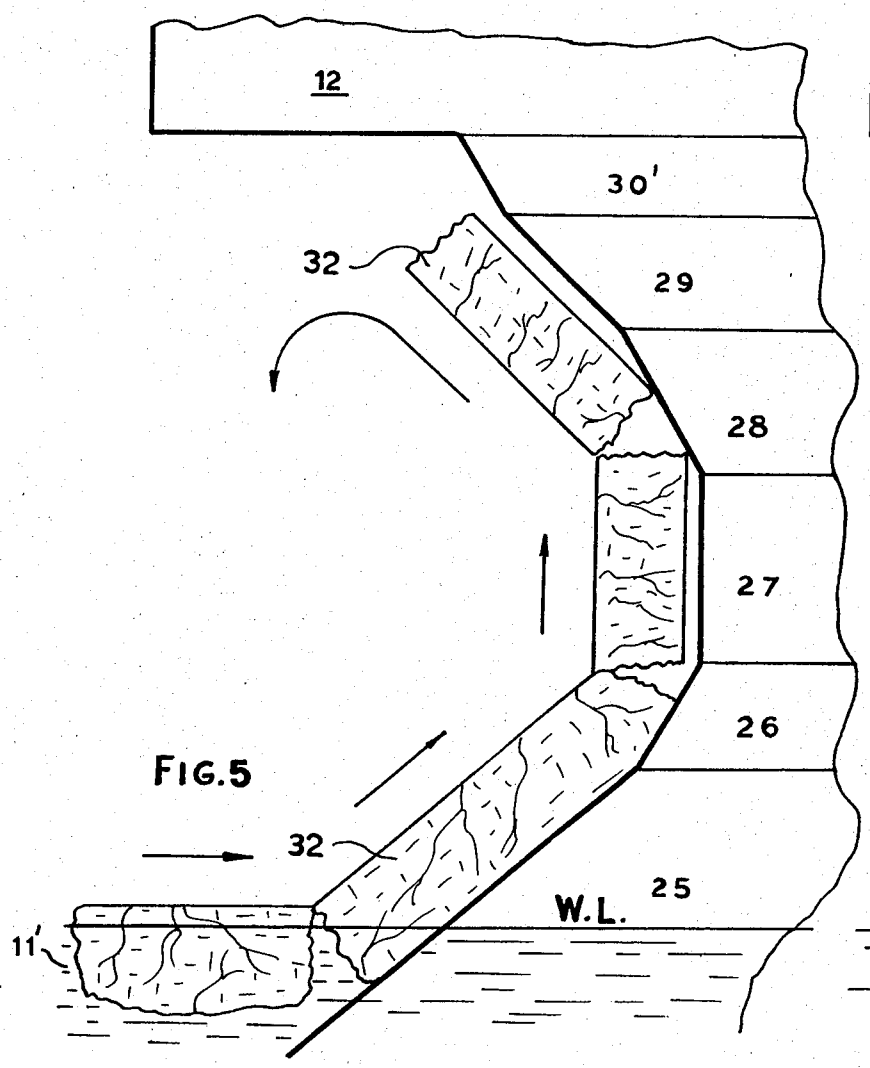
Figure 7:
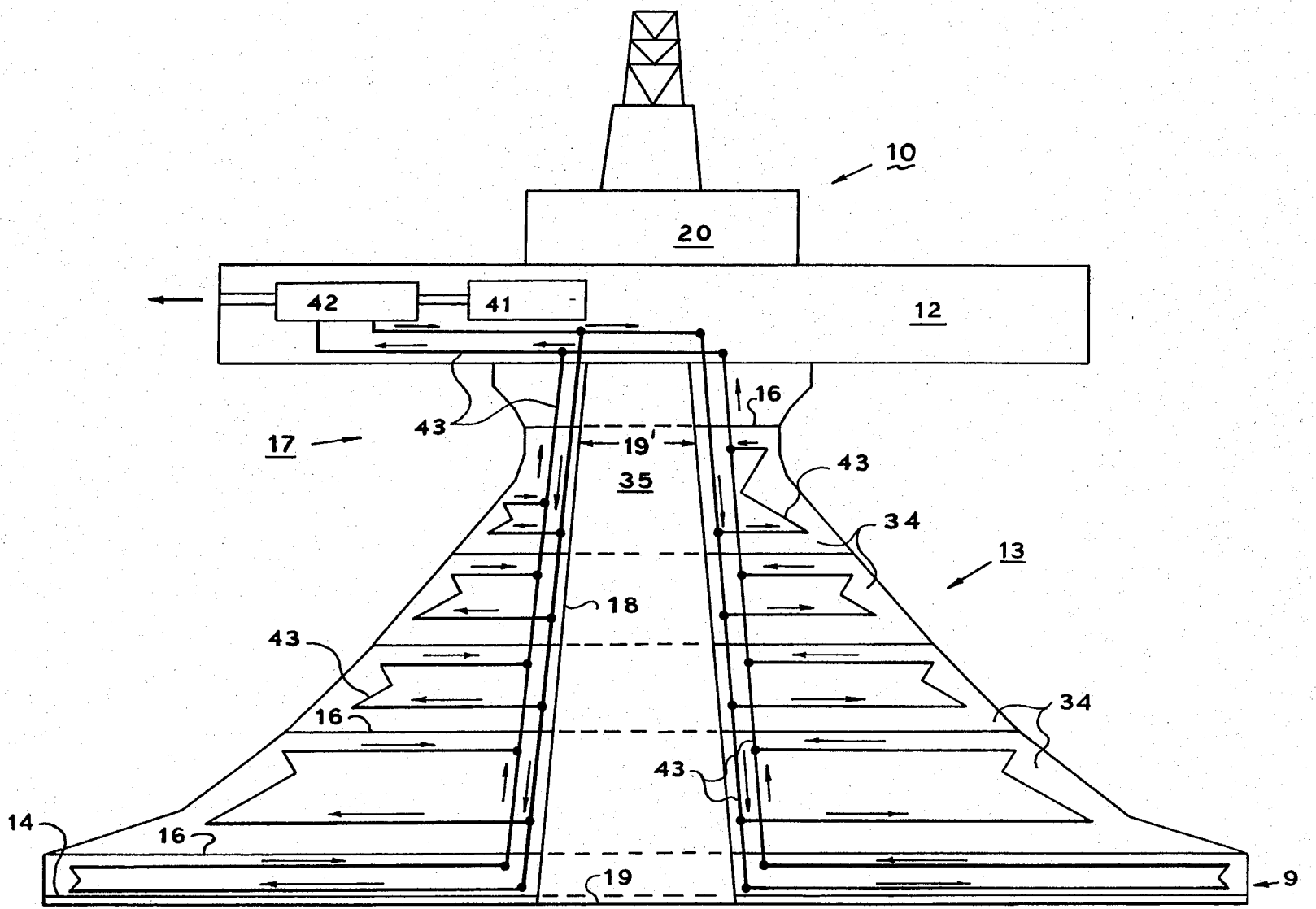
FIG. 7 is a schematic illustration of the water heating system for the ballast tanks to prevent excessive ice accumulation.

With reference to FIGS. 1–8, the marine drilling structure 10 of the present invention is of the submersible bottom-founded type. It comprises a foundational base 9, a lower hull 13, and an upper hull or deck 20.

The base 9 is suitable for placement on the sea floor 11 (FIG. 8) in a body of water 11' having moving ice covers of various thicknesses. Base 9 consists of a flat plate 14 (FIGS. 2–5) from the bottom of which extend vertically and downwardly a plurality of skirts 15 and a surrounding matching polygonal cylindrical wall 21.

Skirts 15 have a plurality of lateral gussets 15', as shown.

Deck 12 can be round or rectangular in plan view, and portions of the deck are cantilevered over the lower hull 13. The bottom of deck 12 is 25 meters above the water line W.L. (FIG. 5) in 60 meters of water to avoid impingement by ride-up ice blocks 32 against the deck.

Deck 12 has a large enough top surface to accommodate conventional drillworks 20, such as two conventional drilling rigs, personnel quarters, and most support equipment (not shown). Deck 20 comprises compartments for storing drill pipe, casing, consumables, and supplies in sufficient quantities to support two simultaneous and independent well-drilling operations over a relatively large access area 19 (FIG. 7) to the sea bed 11. Deck 12 has sufficient storage capacity and deck space to support twelve months of operation without any major resupply.

The lower hull 13 includes base 9, an internal frame assembly 16, and a multi-slope deflector section 17. The internal frame 16 forms a continuously sloping inner wall 18 (FIG. 2) which provides the access area 19 into the sea bed 11 for extending therethrough the drilling operations.

Hull 13 has an outer wall formed by a plurality of ice-engaging wall sections starting from cylindrical base 9 and extending up to deck 12. Hull 13 is a 16-sided polygon and is so shaped in accordance with this invention as to be able to drill in water depths between 20–60 meters. More specifically, hull 13 includes:

a frusto-conical first outer wall 22 which extends upwardly from and above base 9 to an elevation of at least 3 meters above the base and at an angle to the horizontal of at least 12°;

a matching polygonal, frusto-pyramidal, apex-up, second outer wall 23 which extends above first wall 22 at an angle to the horizontal of 20°–45° and to an elevation of at least 15 meters above first wall 22;

a matching polygonal, frusto-pyramidal, apex-up, third outer wall 24 which extends above second wall 23 at an angle to the horizontal of 30°–50° and to an elevation of at least 25 meters above third wall 24;

a matching polygonal, frusto-pyramidal, apex-up, fifth outer wall 26 which extends above fourth wall 25 at an angle to the horizontal of 50°–70° and to an elevation of at least 3 meters above fourth wall 25;

a matching polygonal, cylindrical first transitional and sixth outer wall 27 which extends substantially vertically above fifth wall 26 to an elevation of at least 3 meters above fifth wall 26;

a matching polygonal, frusto-pyramidal, apex-down, seventh outer wall 28 which extends above sixth wall 27 at an angle to the horizontal of 95°–135° and to an elevation of at least 3 meters above sixth wall 27;

a matching polygonal, frusto-pyramidal, apex-down, eighth outer wall 29 which extends above seventh wall 28 at an angle to the horizontal of 120°–150° and to an elevation of at least 3 meters above seventh wall 28; and a matching polygonal, frusto-pyramidal, apex-down, second transitional and ninth outer wall 30 or 30' which extends above eighth wall 29 at an angle to the horizontal of 90°–140°, but at an angle less than the angle of eighth wall 29, and to an elevation of at least 1 meter above eighth wall 29.

The deflector section 17 (FIGS. 5–6) extends up to the bottom of deck 20 and consists of walls 27–30 or 27–30' which together serve to prevent possible serious damage which may be caused by ice impingements against the bottom of deck 12 and especially to the main structural bulkheads. As previously mentioned, deflector 17 has two transition walls 27 and 30 or 30': the first changes the slope of wall 26 from an inwardly and upwardly to an outwardly and upwardly (wall 28), and the second reduces the slope of wall 29 from outwardly and upwardly to a less outwardly wall 30' or to the vertical wall 30. The preferred second transitional wall is wall 30. In this manner, deflector 17 provides sufficient clearance for rotating ice blocks 32 to fall back by gravity without being able to reach and strike deck 12.

The internal frame assembly 16 of hull 13 is compartmentalized, by radial and circumferential partitions between inner wall 18 and the outer walls, into watertight ballast tanks 34 suitable for all required ballasting purposes. Control rooms (not shown) are also provided for controlling the heating, ballasting, and jetting systems.

The continuously sloping inner wall 18 defines a moonpool space 35 penetrating and extending through deck 12 and base 9 to accommodate two drill strings 40 and multiple wellheads (not shown). Moonpool 35 has a 300 $m^2$ access area 19' at the neck of hull 13 and a 750 $m^2$ access area 19 at the sea bed 11.

Figure 8:
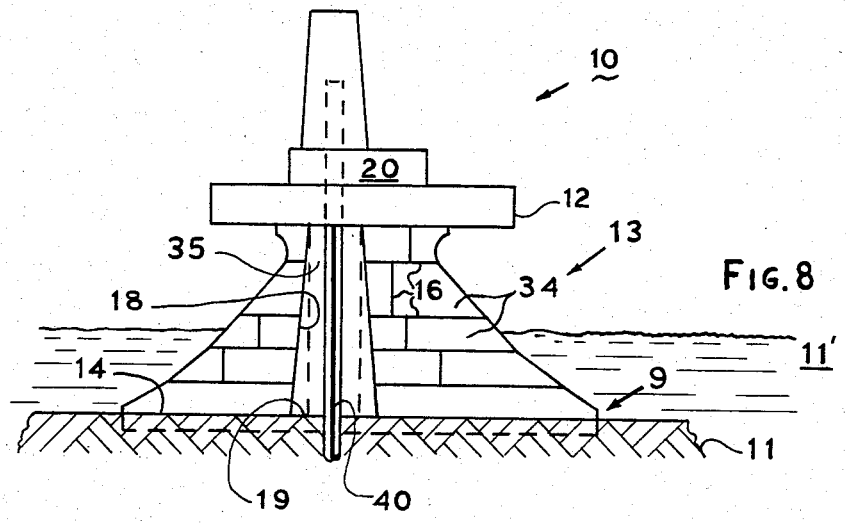
FIGS. 8–10 illustrate the function of the sloping inner walls which form the moonpool.
Figure 9:
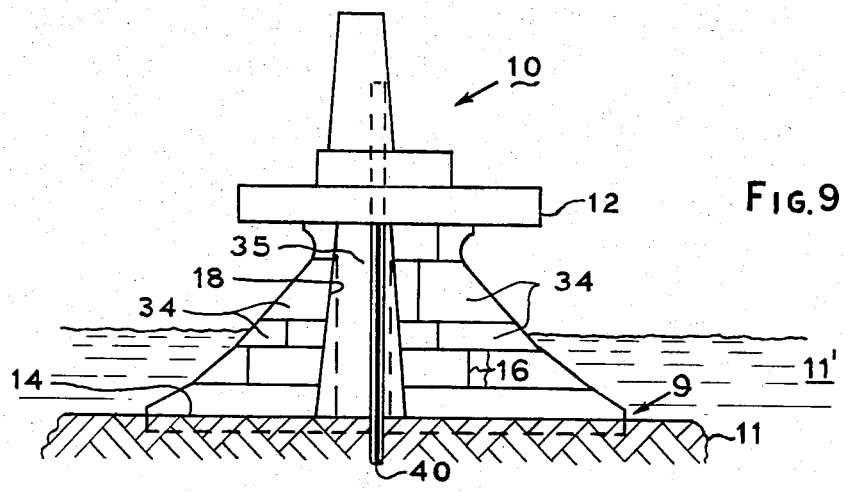
Figure 10:
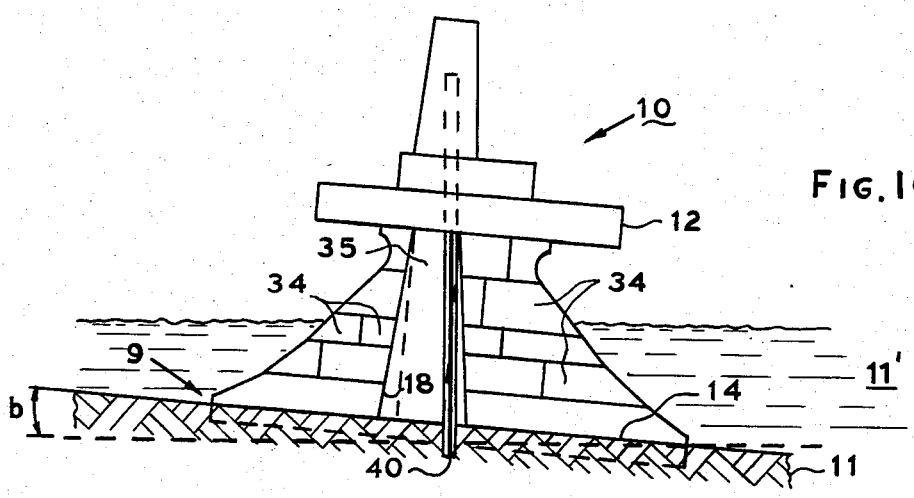

As shown in FIGS. 8–10, if structure 10 (FIG. 8) was level, moonpool 35 had vertical walls 18, and the drill string 40 was in the center of the moonpool, the drill hole in sea bed 11 would also be in the center of the moonpool for receiving the drill string.

If structure 10 (FIG. 9) was level, moonpool 35 had vertical walls, and the drill string was at the edge of the moonpool, the drill hole would also be at the edge of the moonpool. In that event if structure 10 was tilted say by an angle b, there could be interference between the drill string and the moonpool's wall 18.

In accordance with this invention, if plate 14 of base 9 (FIG. 10) is tilted up to 2° relative to the horizontal, the taper on wall 18 is sufficient to prevent interference with the drill string. The drill strings 40 are thus protected against ice impingements and against interference with wall 18 in the event that structure 10 should become slightly tilted up to 2°.

The wall sections of hull 13 can be constructed of reinforced concrete or steel suitable for arctic use. In practice, straight-edge, thick, flat steel plates are welded together, edge to edge, in order to provide an approximate circular contour. Each pair of adjacent plates has a dihedral angle of about 157°.

A preferred structure 10 according to the present invention has a base diameter of 200 meters, an overall lightship weight of approximately 200,000 tons, a minimum hull neck diameter of 51 meters, and a moonpool 35 providing a sufficient sea bed access area 19 for drilling up to 48 wells. Some dimensions of one tested structure are given in FIG. 1, wherein the wall elevations are in meters and the angles are in degrees, and other dimensions are given throughout the specification.

The maximum towing draft of structure 10 is 9 meters, so that it can be installed in and navigated through relatively shallow waters. The setdown draft is no less than 20 meters and no greater than 60 meters for operation in ice-covered waters.

The loads which will be generated due to ice interaction with structure 10 will depend on the energy available in the environment, physical characteristics of the ice features encountered, and the failure modes induced in the encroaching ice covers.

There are three principal ice failure modes: crushing, shearing, and flexural. Continuous crushing requires the largest force (ice pressures exceeding 1000 psi are possible), while flexural mode requires the least force (flexural strength of sea ice is less than 100 psi). Because ice is weak in tension and strong in compression, hull 13 will cause ice to fail in flexure. This is done by bending the ice and making it ride up on the hull's progressively inclined outer walls.

When a continuous ice mass, which may extend for many kilometers in all directions around structure 10, moves toward and encroaches on the structure (FIGS. 5-6), the hull's outer sloping walls develop vertical and horizontal force components on the ice edge, radial and circumferential cracks propogate outward in the ice cover, and the ice gradually bends upward and rearward until it breaks up into large slabs 32 which rotate gradually until they are parallel to first transitional wall 27.

From wall 27 the ice is pushed to ride up on the inclined walls 28-29 until gravity forces them to turn over and fall back on top of the incoming ice mass. As can be seen from the drawings, the second transitional wall 30 or 30' prevents the falling ice slabs 32 from reaching and striking the bottom of deck 20.

Because structure 10 has a relatively large neck diameter, the fallen ice slabs accumulate as rubble in front of the structure. The approaching ice mass now sees a pile of rubble in front of it instead of the structure itself and must first interact with the rubble.

The rubble pile causes the global load on structure 10 to increase until the growth of the rubble pile reaches an equilibrium state where ice entering the rubble mass equals the mass of ice clearing past the structure.

Ice loads are reacted through structure 10 to the sea bottom 11. In shallow waters, apart from structural integrity, the principal concern is that base 9 does not slide on sea floor 11. Foundation soil properties and resistance are the most important factors in providing resistance, which depends on shearing of the soil at a point in the soil below the base-soil interface. The skirts 15 of base 9 make the most efficient use of in situ soil conditions.

At the deeper operating drafts, the horizontal force component exerted by the ice on structure 10 can create a significant overturning moment, but the weight of structure 10, the size of its base 9, and its massive ballast provide sufficient gravity load to hold the structure on location even over poor foundation soils. The vertical load component exerted by the ice on structure 10 tends to further reduce the overturning moment created by the ice.

Structure 10 is first installed by positioning its base 9 over the desired drilling site and then flooding the ballast compartments 34 until base 9 sinks down to sea bed 11. Then the sea water ballast is increased until a sufficient gravity load is provided to resist the maximum expected ice loads.

In order to refloat structure 10, water is pumped out from the ballast tanks 34. Refloating can be facilitated by jetting water under base 9.

Since the summer season is relatively short, there is usually no more than one month to relocate structure 10 to a new site and to resupply. But because structure 10 requires no sea bed preparations prior to relocation, the time required to relocate the structure will depend primarily on the time required to deballast and reballast the structure, on the towing distance to the new site, and on local ice conditions which may interfere with the towing operations.

In the winter, ballast tanks 34 located above the waterline W.L. are exposed to freezing temperatures as low as −50° C., and the tanks 34 located below the waterline are immersed in the sea environment, the temperature of which below the ice cover remains at about −3° C.

At the start of the winter season, ice quickly grows on the inside of those ballast tanks 34 which are exposed to the freezing temperatures. Then the growth of the ice progressively diminishes due to the natural insulation properties of the ice itself. Totally preventing ice from forming on the exposed ballast tanks would be an undesirable waste of energy. On the other hand, allowing ice to accumulate unimpeded in the ballast tanks would present floating stability problems and would delay the relocation of structure 10 in the summer to another drilling site.

Use is made of the the waste heat produced by the power generators 41 (FIG. 7) which operate the rotary tables, drawworks, mud pumps, and other equipment used in the drilling operations. To that end, a heat exchanger 42 extracts waste heat from the generator's exhaust gasses and dumps the extracted energy into a ballast tank heating system 43. Approximately 45 cm of ice is allowed to grow on the inside walls of the ballast tanks. Thereafter, heating system 42 will raise the temperature of the water in the ballast tanks to slightly above −3° C. Additional heat, if required, can be obtained from standby heat sources (not shown) to supplement the waste heat recovery system 42.

Structure 10 can accommodate the drilling of up to 48 exploration and developmental wells within a single location within a water depth of 60 m. All that is required to shift from exploration drilling mode to production drilling mode is to change the equipment on deck 12. No major prior structural changes need be made to structure 10.

Models of hull 13 and deck 12 have been tested under simulated arctic conditions to evaluate ice loads generated against structure 10 as a function of operating water depths and for a variety of design ice conditions. The models were built from wood on a scale of 1/100 and 1/60.

It was found that due to the efficient conical geometry of hull 13 when combined with the 200-meter diameter of base 9, structure 10 will safely carry out exploratory and developmental well drilling and production operations in water depths ranging from 20-60 m over a wide range of sea bed soil conditions.

It was further found that because of the unique shape of hull 13, the forces acting on structure 10 are fairly uniform over its entire water depth operating range of 20-60 meters, and principally for that reason structure 10 is suitable for drilling on leases located in varying isobaths and having different environmental conditions.

What is claimed is:

1. A mobile marine drilling structure of the submersible bottom-founded type for operation in arctic waters, said structure including a base for placing the structure on the sea bed, a hull extending from the base, and a deck supported by the hull and located at a safe elevation above the water line for conducting drilling operations and having sufficient deck space to accommodate drilling equipment and supplies, said hull having an internal frame assembly including external wall sections at different inclinations to the horizontal to engage and break up the moving ice masses encroaching on the hull, the improvement wherein said external wall sections include a plurality of matching polygonal, frusto-pyramidal, apex-up walls extending above the base at increasing angles to the horizontal from about 12° to 75°; a matching polygonal, substantially cylindrical, first transitional wall extending substantially vertically above the apex-up walls; at least one matching polygonal, frusto-pyramidal, apex-down wall extending above the cylindrical wall at an angle to the horizontal from 95° to 150°; and a matching polygonal, second transitional wall extending above the apex down wall at an obtuse angle to the horizontal from 90° to 140°, and said obtuse angle being less than the angle of said apex-down wall.

2. The structure according to claim 1, wherein said structure has ballast tanks and a ballast water heating system for controlling the growth of ice on the interior surface of the ballast tanks and the temperature of the ballast water.

3. The structure according to claim 1, wherein said hull has an inner wall extending from the deck down to and through the base, and said inner wall having an inwardly sloping profile from the base up to the deck, to provide sea bed access for drilling operations even when said structure tilts up to about 2° to the horizontal, thereby protecting the drilling operations against interference with said inner wall.

4. The structure according to claim 3, wherein said ballast water heating system in said hull limits the growth of ice on the interior surface of said ballast tanks to less than 45 cm.

5. A mobile marine drilling structure of the submersible bottom-founded type for operation in arctic waters over which ice covers of various thicknesses move, said structure including a base for placing the structure on the sea bed, a hull extending from the base, and a deck supported by the hull, the deck being located at a safe elevation above the water line for conducting drilling operations and having sufficient deck space to accommodate drillng equipment and supplies, said hull having an internal frame assembly and external wall sections at different inclinations to the horizontal to engage and break up the moving ice masses encroaching on the hull, the improvement wherein said external wall sections include a frusto-conical first wall extending upwardly from and above said base to an elevation of at least 3 m and at an angle to the horizontal of at least 12°;

a matching polygonal, frusto-pyramidal, apex-up, second wall extending above the first wall at an angle to the horizontal from 20° to 45° and to an elevation of at least 15 m above said first wall;

a matching polygonal, frusto-pyramidal, apex-up, third wall extending above the second wall at an angle to the horizontal from 30° to 50° and to an elevation of at least 10 m above said second wall;

a matching polygonal, frusto-pyramidal, apex-up, fourth wall extending above the third wall at an angle to the horizontal from 45° to 60° and to an elevation of at least 25 m above said third wall;

a matching polygonal, frusto-pyramidal, apex-up, fifth wall extending above the fourth wall at an angle to the horizontal from 50° to 70° and to an elevation of at least 3 m above said fourth wall;

a matching polygonal, cylindrical, first transitional and sixth wall extending substantially vertically above the fifth wall to an elevation of at least 3 m above said fifth wall;

a matching polygonal, frusto-pyramidal, apex-down, seventh wall extending above the sixth wall at an angle to the horizontal from 90° to 135° and to an elevation of at least 3 m above said sixth wall;

a matching polygonal, frusto-pyramidal, apex-down, eighth wall extending above the seventh wall at an angle to the horizontal from 120° to 150° and to an elevation of at least 3 m above said seventh wall; and a matching polygonal, frusto-pyramidal, apex-down, second transitional and ninth wall extending to an elevation of at least 1 m above the eighth wall and at an obtuse angle to the horizontal from 90° to 140°, and said obtuse angle being smaller than the angle of said eighth wall.

6. The structure according to claim 5, wherein said sixth-to-ninth walls form a deflector to protect the bottom of the deck against encroaching ice covers, and said deflector causing riding-up ice blocks to rotate away from said structure and then fall by gravity.

7. A mobile marine drilling structure of the submersible type for operation in ice-covered waters, the structure comprising a base for placing the structure on the sea bed, a hull extending from the base, and a deck supported by the hull, the deck being located above the water line for conducting drilling operations, the hull having an internal frame assembly and external wall secions at different inclinations to the horizontal to engage and break up the moving ice masses encroaching on the hull, the improvement, wherein said external wall sections include a plurality of matching polygonal, frusto-pyramidal, apex-up walls and further including a deflector section comprising; a substantially cylindrical wall section, at least one apex-down wall extending above said cylindrical wall at a first obtuse angle to the horizontal, at least another apex-down wall extending above said one apex-down wall at a second obtuse angle to the horizontal which is less than said first obtuse angle so as to provide two inflection points to said deflector section.

* * * * *